United States Patent [19]

Szabo

[11] 4,072,303

[45] Feb. 7, 1978

[54] SPRING CLAMP FOR PAPER LOGS

[76] Inventor: Ferdinand W. Szabo, 17251 McCracken Road, Maple Heights, Ohio 44137

[21] Appl. No.: 786,263

[22] Filed: Apr. 11, 1977

[51] Int. Cl.[2] ..... B25B 1/04

[52] U.S. Cl. ..... 269/131; 269/238; 269/254 CS

[58] Field of Search ..... 269/130–132, 269/238, 254 CS

[56] References Cited

U.S. PATENT DOCUMENTS

| | | | |
|---|---|---|---|
| 787,183 | 4/1905 | Irving | 269/132 |
| 2,513,800 | 7/1950 | Hendrich | 269/130 |
| 3,292,922 | 12/1966 | Nastev | 269/131 |

*Primary Examiner*—Robert C. Watson

*Attorney, Agent, or Firm*—Donnelly, Maky, Renner & Otto

[57] ABSTRACT

A spring clamp for holding a paper log (rolled up newspapers) while twisting tie wires around the end portions thereof. The clamp comprises a pair of spring-actuated curved jaws which have a laterally flexible cord across the free ends of the jaws to embrace the log, the cord extending through jaw openings and being connected to the ends of springs projecting laterally from the jaws. The springs are arranged to buckle when the jaws are separated to provide a large range of opening movement of the jaws by a substantially constant jaw opening force and a substantially constant tension on the cord.

2 Claims, 4 Drawing Figures

SPRING CLAMP FOR PAPER LOGS

BACKGROUND OF THE INVENTION

It is known to form a paper fireplace log by rolling a stack of newspapers into cylindrical form and twisting tie wires around the end portions thereof to prevent unrolling during storage and burning. It is highly inconvenient to hold the log while tying it because such tying is a two-hand operation.

SUMMARY OF THE INVENTION

The present invention provides a simple and efficient form of spring clamp which can be readily expanded to be positioned between the ends of a paper log to yieldably grip the log around substantially its entire periphery to prevent unrolling and to free both hands for installing tie wires around the end portions of the log, whereupon the clamp may be expanded and removed from the tied paper log.

The present invention is usable with a wide range of log diameters with a flexible cord element extending across the free ends of the jaws and connected to the free ends of laterally extending jaw springs which buckle when the jaws are separated so as to maintain a substantially constant log-gripping force and cord tension regardless of log diameter.

DETAILED DESCRIPTION OF A PREFERRED EMBODIMENT

The spring clamp 1 herein comprises a pair of elongated members 2 which are hinged together at 3 to define handles 4 and opposite curved jaws 5 which are adapted to yieldably embrace opposite sides of a paper log L.

Figure 2:
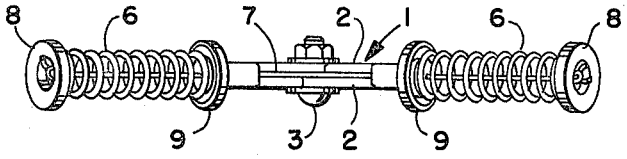
FIG. 2 is a top plan view as viewed along the line to 2—2, FIG. 1.
Figure 1:
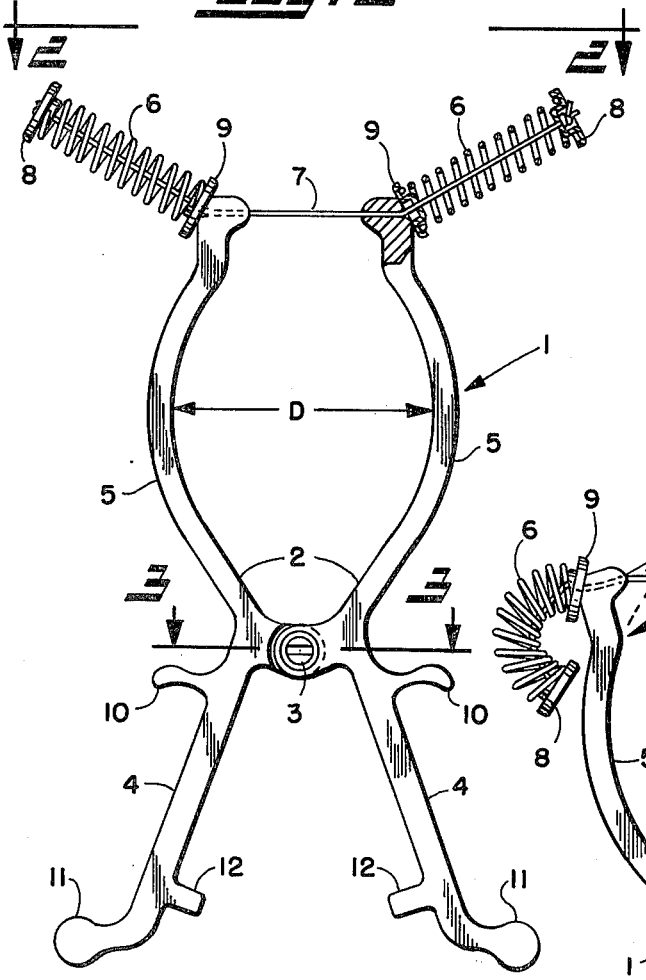
FIG. 1 is a side elevation view, partly in cross-section, of a spring clamp according to present invention.
Figure 3:
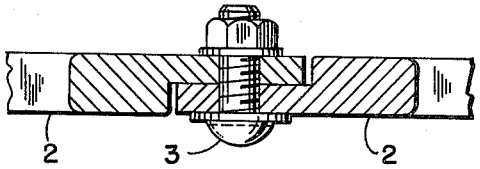
FIG. 3 is a cross-section view on an enlarged scale taken substantially along the line 3—3 FIG. 1.

The clamp 1 is shown in FIG. 1 in its relaxed position with a distance D across the jaws 5 less than the diameter of the smallest paper log adapted to be gripped by the clamp 1 herein. To provide for yieldable gripping of a paper log L between the jaws 5, a pair of coil springs 6 extend laterally from the free ends of the jaws 5 with a flexible cord 7 of nylon or the like extending across the space between the free ends of the jaws 5 and extending through openings in the jaws with the ends of the cord being knotted or otherwise fixed at its ends to the outer spring retainers 8. Inner spring retainers 9 bear against the free ends of the jaws 5 as shown.

The handles 4 have lateral projections 10 and 11 which constitute hand locating means to prevent slippage of the hand when the handles 4 are squeezed together to expand the clamp 1, and in addition, lateral projections 12 are provided on the handles 4 to constitute positive stops to limit the squeezing of the handles 4 to prevent overstressing of the springs 6 and cord 7.

In use, when the clamp 1 is grasped in one hand and squeezed at the handles 4, the curved jaws 5 will separate so that the clamp 1 may be placed on the paper log L, whereupon release of force on the handles 4 will permit the springs 6 to draw the jaws 5 toward each other to yieldably embrace opposite sides of the log L while the portion of the cord 7 between the free ends of the jaws 5 will prevent unrolling of the log thereat.

Figure 4:
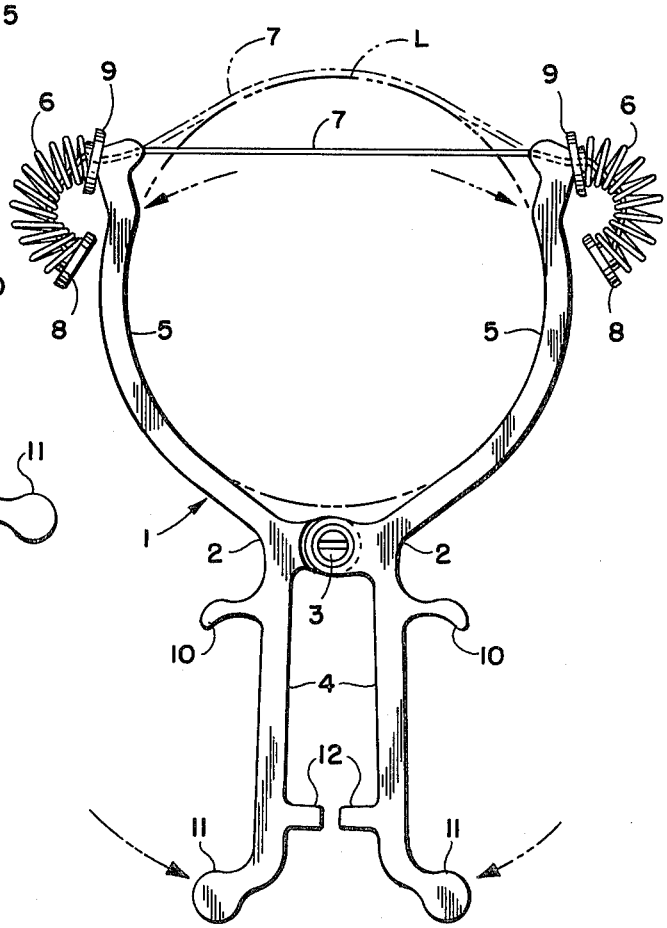
FIG. 4 is a view similar to FIG. 1 except showing the spring clamp in log gripping position.

The springs 6 have the characteristics of a slender column, e.g. a length of wire or strip of spring material, which buckles under axial load of predetermined magnitude and continues to deflect with very little increase in load. Accordingly, the gripping force of the jaws 5 on the log L and the tension in the cord 7 remains somewhat constant regardless of the diameter of the log L. In FIG. 4 the distance between the free ends of the jaws 5 is about 4 times what it is in FIG. 1 and hence an extension spring, such as a screen door spring or a curtain spring, is not usable in the present invention because of permanent deformation if stretched several times its initial active length and because of the progressively increasing force required to so stretch such extension spring from its initial active length to a length several times its initial length.

By way of illustrative example, the jaw 5 and handle 4 members may be of molded plastic material hinged together at 3 to accommodate logs L ranging from about 4 to about 6½ inch diameter with the space between the free ends of the jaws 5 varying from about 1½ to about 6 inches. The springs 6 may be of about 3¼ inch free length and ¾ inch O.D. comprising 12 turns of 0.045 inch diameter spring steel wire, and the cord 7 may a 1/16 inch diameter braided nylon cord. Even when the clamp 1 is fully expanded to the point where the retainers 8 and 9 touch each other and the coils are solid at the inner radii of the curved springs 6 there will be no permanent deformation of the springs 6 and the tension in the cord 7 will be well below the tensile strength of the cord 7.

I claim:

1. A spring clamp for holding a log made of rolled-up newspapers from unrolling during installation of ties around the end portions of the log, comprising a pair of curved jaws hinged together at one end for movement toward and away from each other, said jaws having handles which diverge from said one end thereof and which are adapted to be squeezed together to move said jaws away from each other; and spring means acting on the spaced apart free ends of said jaws for yieldable movement of said jaws as aforesaid into and out of engagement with a log therebetween; said spring means comprising laterally extending elongated slender springs which at one end bear on said free ends, and a flexible cord secured to the other end of said springs and extending through openings in said free ends and across the space therebetween to embrace the portion of the log between said free ends; said springs buckling to longitudinally curved form upon movement of said jaws away from each other thus to yieldably actuate said jaws to grip a log with approximately constant force despite wide variation of log diameter.

2. The spring clamp of claim 1 wherein said springs are coil springs through which the end portions of said cord extend from said openings to said other end of said springs.

* * * * *